US007542016B2

(12) United States Patent
Kim

(10) Patent No.: US 7,542,016 B2
(45) Date of Patent: Jun. 2, 2009

(54) ELECTRON EMISSION DEVICE (EED) WITH LOW BACKGROUND-BRIGHTNESS

(75) Inventor: Seong-Kwon Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 618 days.

(21) Appl. No.: 11/148,199

(22) Filed: Jun. 9, 2005

(65) Prior Publication Data

US 2006/0001612 A1 Jan. 5, 2006

(30) Foreign Application Priority Data

Jun. 30, 2004 (KR) ..... 10-2004-0050477

(51) Int. Cl.
*G09G 3/22* (2006.01)

(52) U.S. Cl. ..... 345/74.1; 341/169.1

(58) Field of Classification Search ..... 345/74.1–83, 345/207; 315/169.1

See application file for complete search history.

(56) References Cited

U.S. PATENT DOCUMENTS

| | | | | |
|---|---|---|---|---|
| 6,404,136 | B1 | 6/2002 | Murray | |
| 6,518,962 | B2 * | 2/2003 | Kimura et al. | 345/211 |
| 6,603,450 | B1 * | 8/2003 | Yamazaki et al. | 345/75.2 |
| 6,707,437 | B1 * | 3/2004 | Kuno et al. | 345/74.1 |
| 6,870,529 | B1 * | 3/2005 | Davis | 345/207 |

FOREIGN PATENT DOCUMENTS

| | | |
|---|---|---|
| CN | 1108801 | 9/1999 |
| JP | 2000-267622 | 9/2000 |
| JP | 2001-324955 | 11/2001 |

OTHER PUBLICATIONS

Office Action from the Chinese Patent Office issued in Applicant's corresponding Chinese Patent Application No. 200510089697.5 dated Feb. 1, 2008.

Registration Determination Certificate from the Chinese Patent Office issued in Applicant's corresponding Chinese Patent Application No. ZL200510089697.5 dated Dec. 24, 2008.

* cited by examiner

*Primary Examiner*—Richard Hjerpe
*Assistant Examiner*—Christopher E Leiby
(74) *Attorney, Agent, or Firm*—Robert E. Bushnell, Esq.

(57) ABSTRACT

An Electron Emission Device (EED) that can reduce background-brightness resulting from collisions between anodes and only a few electrons when data is not supplied to an electron emission display panel includes: an electron emission display panel including scan electrodes, data electrodes, and anodes, electrons colliding with the anode in accordance with a voltage difference between the scan electrodes and the data electrodes; a discharge current measuring unit adapted to measure a discharge current value of the electron emission display panel; a comparison unit adapted to output control signals proportional to a current difference between the measured discharge current value and an inputted reference value; a scan voltage control unit adapted to amplify an output voltage of sequentially outputted scanning signals to scan electrode lines of the electron emission display panel according to scan driving signals having a predetermined frequency, the scan voltage control unit operating in accordance with the control signals of the comparison unit; and a scan driving unit adapted to sequentially supply scan signals having an amplified output voltage to the scan electrode lines, the scan signals having a changed voltage difference between the anode and the scan electrode lines due to the amplified output voltage.

7 Claims, 7 Drawing Sheets

ELECTRON EMISSION DEVICE (EED) WITH LOW BACKGROUND-BRIGHTNESS

CLAIM OF PRIORITY

This application makes reference to, incorporates the same herein, and claims all benefits accruing under 35 U.S.C. §119 from an application for ELECTRON EMISSION DEVICE WITH LOW BACKGROUND-BRIGHTNESS earlier filed in the Korean Intellectual Property Office on Jun. 30, 2004 and there duly assigned Serial No. 10-2004-0050477.

BACKGROUND OF THE INVENTION

1. Field of the Invention

The present invention relates to an Electron Emission Device (EED) that controls background-brightness by adjusting a voltage of scanning signals, and more particularly, to an EED that reduces a voltage difference between a scanning signal voltage and a data electrode line voltage in proportion to a discharge current to reduce background-brightness due to collisions between a few electrons and an anode when data is not being supplied to an electron emission display panel.

2. Description of the Related A

An EED includes an electron emission display panel and a driving device for driving the electron emission display panel. When a positive voltage is supplied to a gate electrode and a negative voltage is supplied to a cathode while a driving device supplies a relatively positive voltage to an anode of the electron emission display panel, electrons are emitted from the cathode and accelerated toward the anode by the potential difference between the gate electrode and the cathode, and then, light is generated by the electrons colliding with the fluorescent cells of the anode.

The gate electrode and the cathode of the electron emission display panel are respectively electrically connected to one of a data electrode line and a scan electrode line. In the course of sequentially supplying scanning signals to the scan electrode line, if a pulse width or a pulse size having a voltage proportional to the brightness is supplied to the data electrode line, electrons are emitted from the cathode by the potential difference between an electrode (the gate electrode or the cathode) connected to the scan electrode line and an electrode (the cathode or the gate electrode) connected to the data electrode line and the electrons are accelerated toward the anode.

The data electrode line and the scan electrode line are disposed on a rear panel (a lower plate) of the electron emission display panel, and the high voltage anode and the fluorescent cells are disposed on a front panel (an upper plate) of the electron emission display panel. Manufacturing a thinner electron emission display panels have been studied to meet market requirements.

However, since the anode of the electron emission display panel is operated at a high voltage of 1-4 KV, a tendency to emit electrons from the cathode, even if the voltage difference between the gate electrode and the cathode does not exceed the discharge firing voltage Vth, occurs as the electron emission display panel becomes thinner. Even if no data signals are supplied to the electron emission display panel, that is, when at least one frame or more than 60 frames are not supplied (that is, "0" data is supplied), electrons are emitted from the cathode and collide with the fluorescent cells of the anode. Therefore, An electron emission display panel looks grey to the viewers. Hereinafter, the brightness of the panel when data is not supplied will be referred to as "background-brightness."

Accordingly, contrast decreases as the background-brightness increases when no data is supplied, thereby requiring a method of reducing the background-brightness.

SUMMARY OF THE INVENTION

The present invention provides an EED panel that can reduce background-brightness due to collisions between only a few electrons, emitted from a cathode, with an anode when no data is supplied to the electron emission display panel.

According to an aspect of the present invention, an Electron Emission Device (EED) is provided comprising: an electron emission display panel including scan electrodes, data electrodes, and anodes, electrons colliding with the anode in accordance with a voltage difference between the scan electrodes and the data electrodes; a discharge current measuring unit adapted to measure a discharge current value of the electron emission display panel; a comparison unit adapted to output control signals proportional to a current difference between the measured discharge current value and an inputted reference value; a scan voltage control unit adapted to amplify an output voltage of sequentially outputted scanning signals to scan electrode lines of the electron emission display panel according to scan driving signals having a predetermined frequency, the scan voltage control unit operating in accordance with the control signals of the comparison unit; and a scan driving unit adapted to sequentially supply scan signals having an amplified output voltage to the scan electrode lines, the scan signals having a changed voltage difference between the anode and the scan electrode lines due to the amplified output voltage.

The discharge current measuring unit is preferably adapted to detect a current flowing through the anode by connecting to the anode of the electron emission display panel.

The discharge current measuring unit is preferably adapted to detect a current flowing through the scan electrode by connecting to the scan electrode of the electron emission display panel.

The EED preferably further comprises a switch unit arranged between the comparison unit and the scan voltage control unit, the switch unit adapted to be turned on in response to a logic value of a predetermined image data being zero.

The switch unit is preferably adapted to be turned on in response to the image data of at least more than one frame being zero.

The switch unit is preferably adapted to be turned on in response to the image data of at least more than 60 frames being zero.

The scan voltage control unit is preferably adapted to reduce a voltage difference between a voltage supplied to the data electrode lines and the output voltage of the scanning signals by controlling the magnitude of the output voltage of the scanning signals to be inversely proportional to the control signals of the comparison unit.

The EED preferably further comprises: an illumination detection unit adapted to output illumination signals by measuring external illumination; and a reference value control unit adapted to generate the reference value by amplifying the illumination signals, the reference value received by the comparison unit being received from the reference value control unit.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention will now be described more fully with reference to the accompanying drawings in which exemplary embodiments of the present invention are shown.

Figure 1:
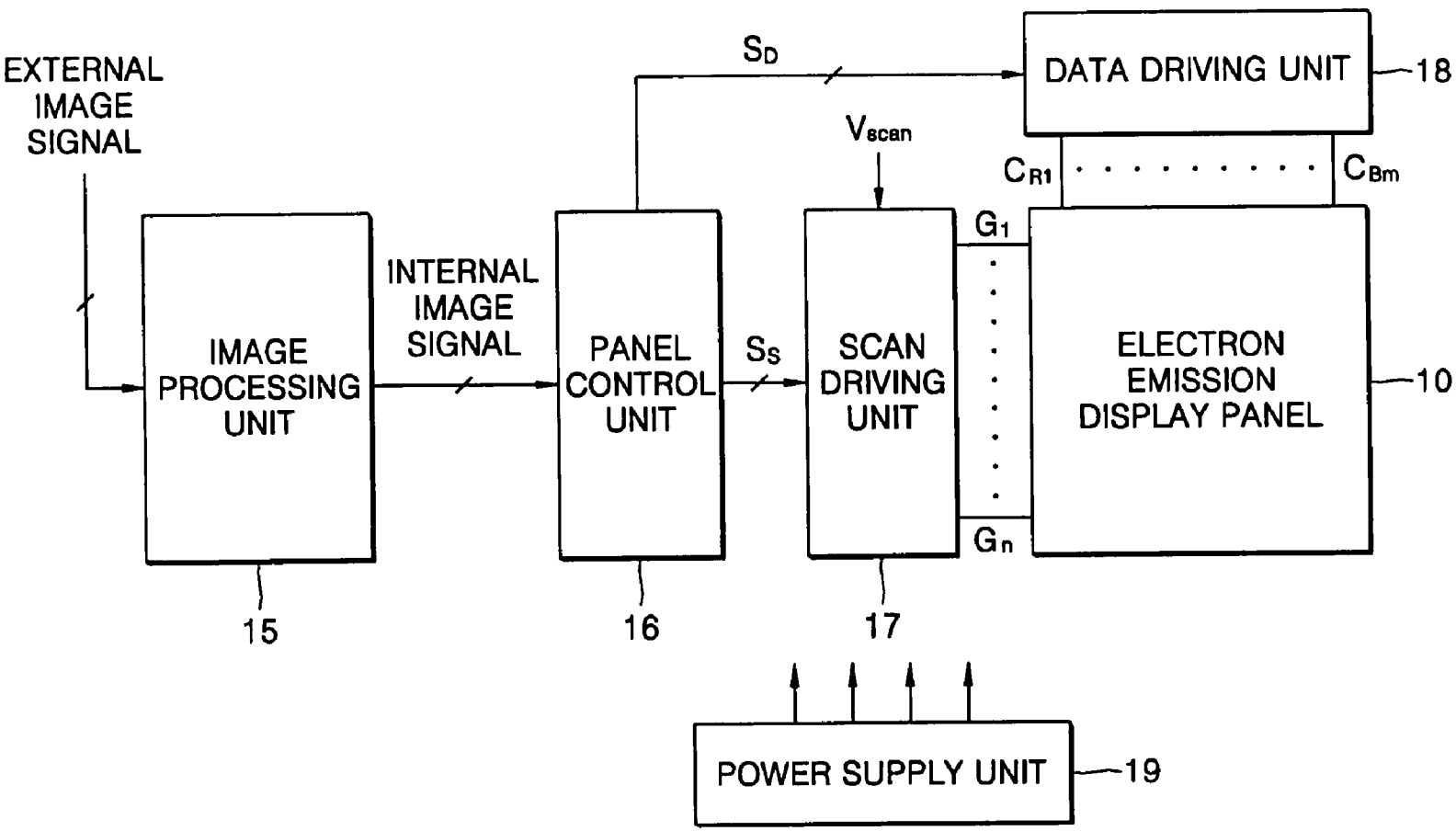
FIG. 1 is a block diagram of an EED according to an embodiment of the present invention.

FIG. 1 is a block diagram of an EED. Referring to FIG. 1, an EED comprises an electron emission display panel 10 and a driving device for driving an electron emission display panel 10. The driving device comprises an image processing unit 15, a panel control unit 16, a scan driving unit 17, a data driving unit 18, and a power supply unit 19.

The image processing unit 15 generates internal image signals, such as red, green, and blue image data, clock signals, and vertical and horizontal synchronizing signals, by transforming external analog image signals into digital signals.

The panel control unit 16 outputs driving control signals $S_D$ and $S_S$ composed of a data-driving control signal $S_D$ and a scan-driving control signal $S_S$ according to the internal image signals transmitted from the image processing unit 15. The data driving unit 18 outputs display data signals by processing the data-driving control signal $S_D$ of the driving control signals $S_D$ and $S_S$ and supplies the outputted display data signals to data electrode lines $C_{R1}, \ldots C_{BM}$ of the electron emission display panel 10. The scan driving unit 17 supplies the scan-driving control signal $S_S$ of the driving control signals $S_D$ and $S_S$ transmitted from the panel control unit 16 to scan electrode lines G1, . . . Gn after processing. The scan driving unit 17 receives a predetermined voltage Vscan from the power supply unit 19 to increase a low voltage scan signal of a logic level to a required voltage in the scan electrode lines (a gate electrode or a cathode).

The power supply unit 19 supplies power required by the image processing unit 15, the panel control unit 16, the scan driving unit 17, the data driving unit 18, and the electron emission display panel 10.

Figure 2:
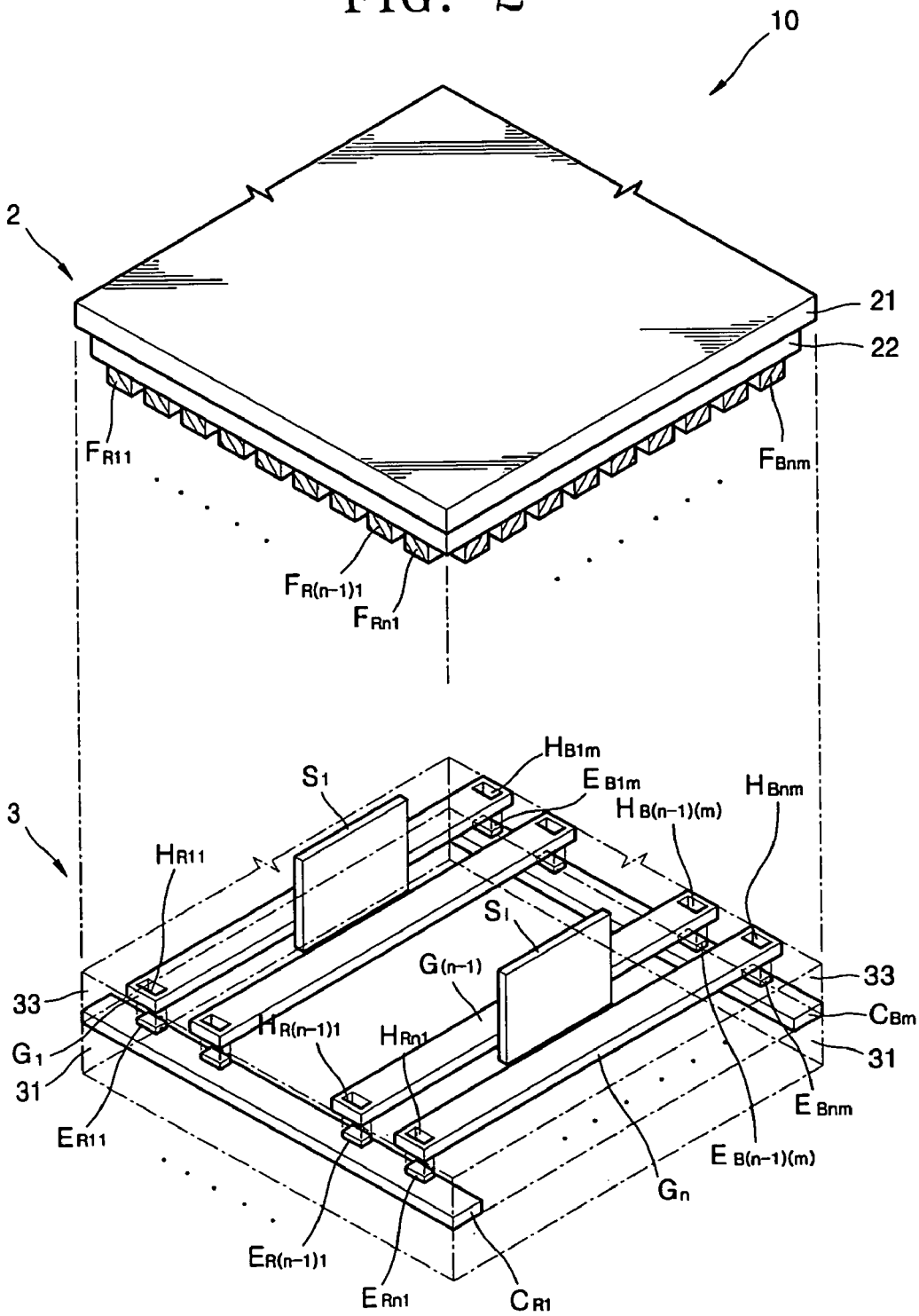
FIG. 2 is a perspective view of a normal-gate electron emission display panel of a EED according to an embodiment of the present invention.

FIG. 2 is a perspective view of a normal-gate electron emission display panel of an electron emission device according to an embodiment of the present invention.

Referring to FIG. 2, in the embodiment of the present invention, a front panel 2 and a rear panel 3 of the electron emission display panel 10 are supported by spacer bars $S_1$ through $S_i$.

The rear panel 3 includes a rear substrate 31, cathode lines $C_{R1}, \ldots, C_{Bm}$, electron emitters $E_{R11}, \ldots, E_{Bnm}$, and gate electrode lines $G_1, \ldots, G_n$. The cathode lines $C_{R1}, \ldots, C_{Bm}$ on which data signals are supplied are electrically connected to the electron emitters $E_{R11}, \ldots, E_{Bnm}$. Through holes $H_{R11}, \ldots, H_{Bnm}$ corresponding to the electron emitters $E_{R11}, \ldots, E_{Bnm}$ are formed in a first insulating layer 33 and the gate electrode lines $G_1, \ldots, G_n$. The throughholes $H_{R11}, \ldots, H_{Bnm}$ are formed on a region crossing the cathode lines $C_{R1}, \ldots, C_{Bm}$ on the gate electrode lines $G_1, \ldots, G_n$ on which scan signals are supplied.

The front panel 2 includes a transparent substrate 21, an anode 22, and fluorescent cells $F_{R11}, \ldots, F_{Bnm}$. A high positive voltage of 1-4 KV emitted by the electron emitters $E_{R11}, \ldots, E_{Bnm}$ is supplied to the anode 22.

For example, when the data electrode lines $C_{R1}, \ldots, C_{Bm}$ are connected to the cathodes and the scan electrode lines $G_1, \ldots, G_n$ are connected to the gate electrodes, and a positive voltage is supplied to the anode, a positive voltage is supplied to the gate electrodes through the scan electrode lines $G_1, \ldots, G_n$ and a negative voltage is supplied to the cathodes through the data electrode line $C_{R1}, \ldots, C_{Bm}$, electrons are emitted from the cathodes, accelerated toward the gate electrodes, and converged on the anodes. Then, the electrons collide with fluorescent cells disposed directly in front of the anodes, thereby emitting light from the fluorescent cells.

Figure 3:
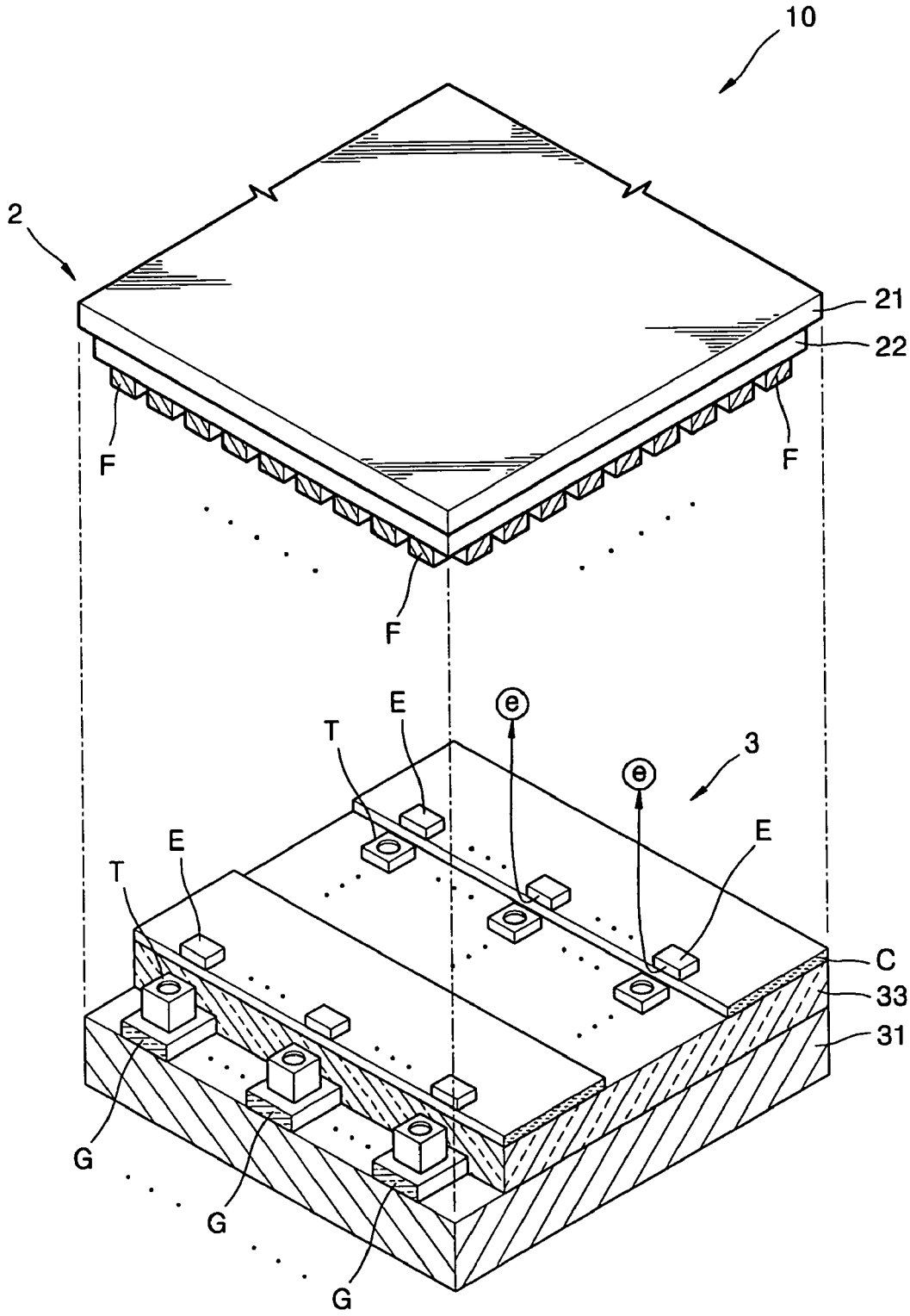
FIG. 3 is a perspective view of an under-gate electron emission display panel of an EED according to an embodiment of the present invention.

FIG. 3 is a perspective view of an under-gate electron emission display panel of an electron emission device according to an embodiment of the present invention.

Referring to FIG. 3, the electron emission display panel on FIG. 3 is different from the electron emission display panel of FIG. 2 in that the gate electrode lines G are located under the cathode lines C. The rear panel 3 of FIG. 3 comprises a rear substrate 31, cathode lines C, electron emitters E, an insulating layer 33, and gate electrode lines G.

The cathode lines C, on which data signals are supplied, are electrically connected to the electron emitters E. Counter-electrodes T extending to the electron emitters E through the insulating layer 33 are formed on the gate electrode lines G.

As depicted in FIG. 3, in an electron emission display panel having a structure in which the gate electrode lines G are located under the cathode lines C, electrons emitted from the cathodes due to the potential difference between the gate electrode and the cathodes are accelerated toward the anodes of the front panel 2 after dragging slightly toward the gate electrodes.

The front panel 2 includes a front transparent substrate 21, anodes 22, and the fluorescent cells $F_{R11}, \ldots, F_{Bnm}$. A high positive voltage of 1-4 KV emitted from the electron emitters $E_{R11}, \ldots, E_{Bnm}$ is supplied to the anodes 22 to move the electrons toward the fluorescent cells.

Figure 4:
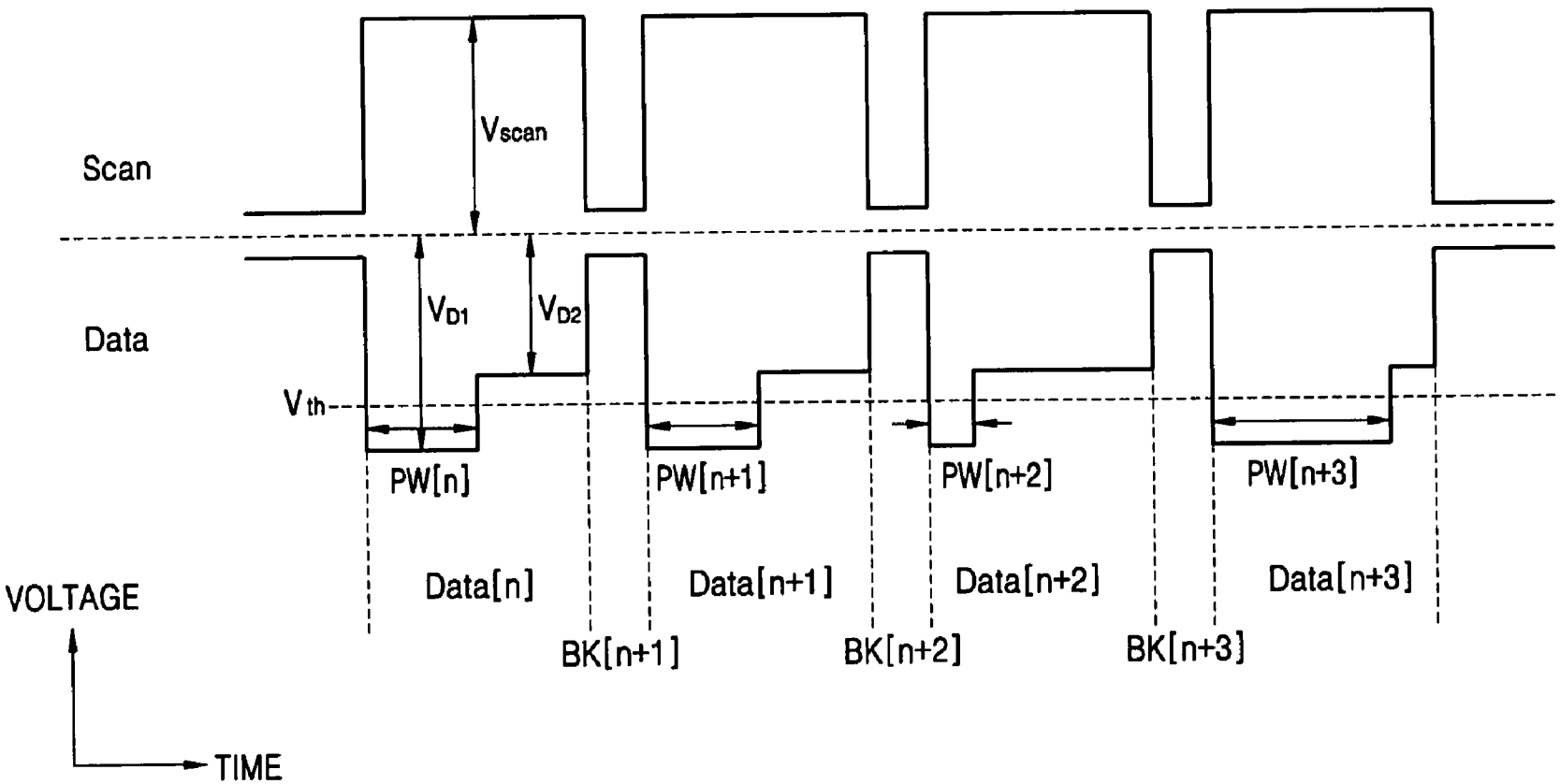
FIG. 4 is a view of waveforms of a display data signal and a scan signal supplied to a data electrode line and a scan electrode line of an electron emission display panel.
Figure 5:
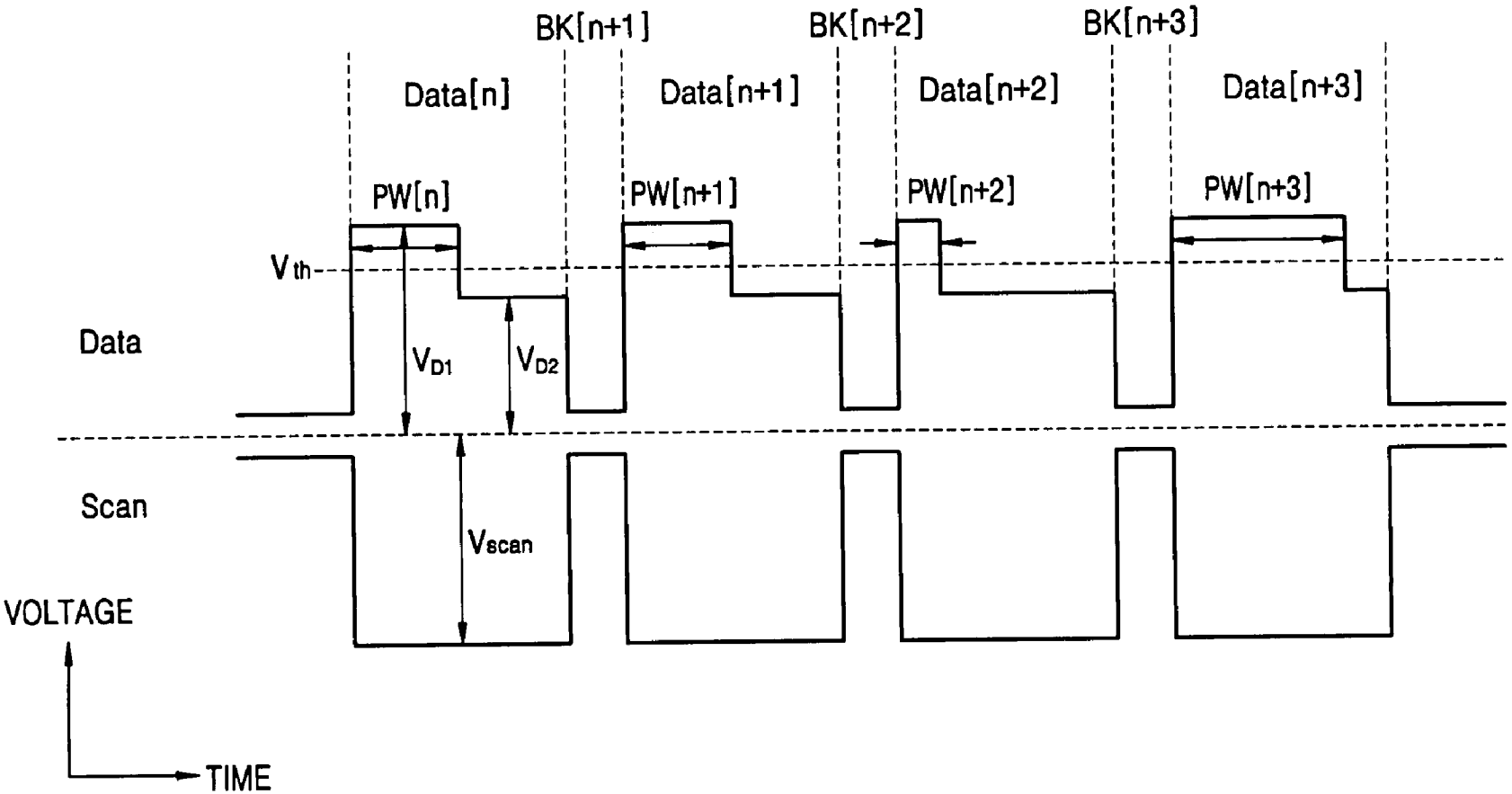
FIG. 5 is a view of waveforms of a display data signal and a scan signal supplied to a data electrode line and a scan electrode line of an electron emission display panel.

FIGS. 4 and 5 are views of waveforms of a display data signal and a scan signal respectively supplied on a data electrode line and a scan electrode line of an electron emission display panel.

The waveforms depicted in FIG. 4 can generally be used in an electron emission display panel having a structure in FIG. 2 in which the scan electrode lines are connected to the gate electrodes and the data electrode lines are connected to the cathodes. However, the present invention is not limited thereto.

As depicted in FIG. 4, when positive scanning signals having a uniform width are sequentially and repeatedly supplied to the scan electrode lines, display data signals having different Pulse Widths PW according to the brightness are supplied to one of the data electrode lines. The display data signal is composed of a first data voltage $V_{D1}$ which is greater than a discharge firing voltage Vth and a second data voltage $V_{D2}$ which is less than the discharge firing voltage Vth. Output brightness is determined according to a pulse width wide enough to maintain a voltage difference Vscan $+V_{D1}$ between the voltage Vscan of the scan electrode lines and the first data voltage $V_{D1}$, that is, a pulse width of the first data voltage $V_{D1}$. For example, if the grey scales of a first data signal Data[n] and a second data signal Data[n+1] are equal, the output pulse widths are equal, that is, PW[n]=PW[n+1]. Also, if the grey scale of a third data signal Data[n+2] is low, the output pulse width is short, and if the grey scale of a fourth signal Data[n+3] is high, the output pulse width is longer.

The thickness of the electron emission display panel 10 and a gap between the front panel 2 and the rear panel 3 are directly proportional. Therefore, there are the problems of decreasing contrast and increasing background-brightness due to the emission which results from only a few electrons due to a high voltage supplied to the anode in a period when a data signal is not supplied, that is, a section that the second data voltage $V_{D2}$ is maintained, i.e., the data signal is zero.

Accordingly, in the present invention, a discharge current in the section in which the data signal is zero, i.e., in the section that the second data voltage $V_{D2}$ is maintained, is measured. A magnitude of a voltage Vscan of the scan signal is then reduced according to the measurement results.

FIG. 5 is a view of waveforms in which the polarities of the scan signal and the data signal are reversed but the operation of the electron emission display panel according to the signal supplied is identical to that of FIG. 4. The waveforms in FIG. 5 generally can be supplied to a panel having a structure in FIG. 3 in which the scan electrode lines are connected to the cathode and the data electrode lines are connected to the gate electrodes. However, the present invention is not limited thereto.

As depicted in FIG. 5, when a reversed polarity having a uniform width is sequentially and repeatedly supplied to the scan electrode lines, display data signals having different pulse widths according to the brightness are supplied to one of the data electrode lines. The display data signal is composed of a first data voltage $V_{D1}$ which is greater than a discharge firing voltage Vth and a second data voltage $V_{D2}$ which is less than the discharge firing voltage Vth. Output brightness is determined according to a pulse width wide enough to maintain a voltage difference Vscan $+V_{D1}$ between the voltage Vscan of the scan electrode lines and the first data voltage $V_{D1}$, that is, a pulse width of the first data voltage $V_{D1}$.

Figure 6:
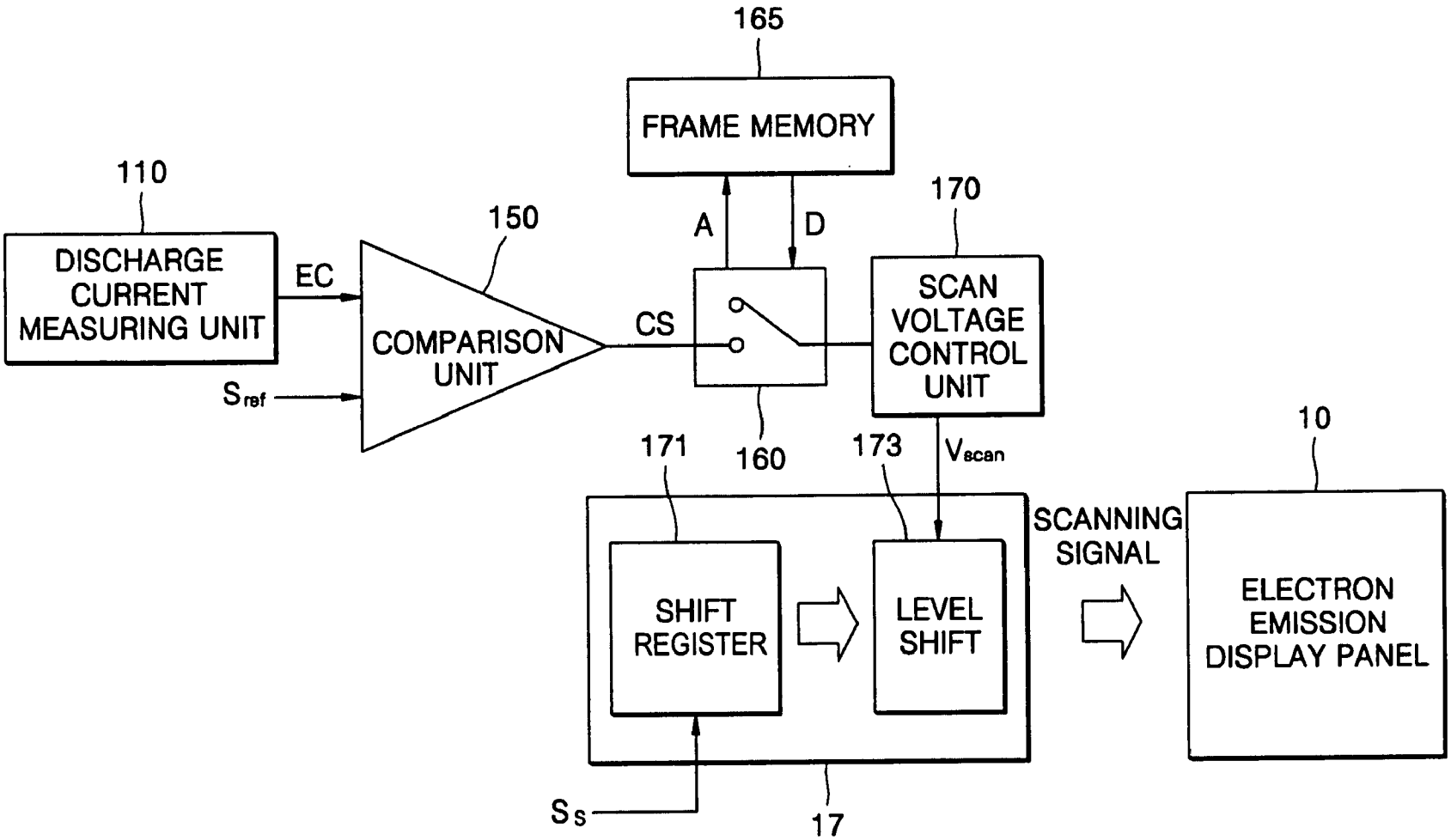
FIG. 6 is a block diagram of an EED that controls the voltage of a scan signal according to an embodiment of the present invention.

FIG. 6 is a block diagram of an electron emission device that can control the voltage of a scan signal according to an embodiment of the present invention. An electron emission device according to the present invention sequentially outputs scan signals to scan electrode lines of an electron emission display panel according to scan driving signals having a predetermined frequency, wherein the electron emission display panel includes scan electrodes, data electrode, and anodes with which collisions occur between electrons emitted due to a voltage difference between the scan electrode and the data electrode. The basic concept of the EED according to the present invention is to prevent emission of electrons from electrodes on the scan electrode lines by adjusting the potential of the data electrodes to be close to the potential of the scan electrodes when no data is supplied to the data electrode lines.

Referring to FIG. 6, the electron emission device according to the present invention comprises a discharge current measuring unit 110 that measures a discharge current value EC of an electron emitting panel 10, a comparison unit 150 that outputs control signals CS proportional to a difference between the discharge current value EC and a reference value Sref by receiving the discharge current value EC and the reference value Sref, a scan voltage control unit 170 that supplies power for amplifying an output voltage Vscan of the scan signal according to the control signal CS of the comparison unit 150, and a scan driving unit 17 that sequentially supplies scan signals with an amplified output voltage Vscan to the scan electrode lines, by which the potential difference between the scan voltage and the anode voltage is changed.

The discharge current measuring unit 110 can be connected to the anode 22 to detect a current flowing through the anode 22 of the electron emitting display panel 10. As an example, the discharge current measuring unit 110 can be an ammeter connected in series between the anode 2 and a power supply unit 19.

On the other hand, the discharge current measuring unit 110 can be connected to the scan electrode lines to measure a current flowing through the scan electrodes. As an example, the discharge current measuring unit 110 can be an ammeter connected in series between the scan electrode lines and a power supply unit 19. As depicted in FIG. 2, if the gate electrodes G are located in the cathodes C, the discharge current measuring unit 110 can measure the discharge current of the gate electrodes on the scan electrode lines since the gate electrodes are preferably scan electrode lines and the cathodes C are preferably connected to the data electrode lines.

The discharge current measuring unit 110 measures a current flowing in the anode 22 or the scan electrode lines and outputs a discharge current value EC, which is proportional to the current measured. The discharge current value EC can be any value proportional to the discharge current value EC or digital data.

The comparison unit 150 outputs a control signal proportional to a difference value between a discharge current value EC and a reference value Sref by receiving the discharge current value EC and the reference value Sref. The discharge current value EC and the reference value Sref can be an analog voltage, an analog current value, or digital data, etc. If the comparison unit 150 is a differential amplifier, the outputted control signal CS is a voltage which is proportional to the voltage difference between the discharge current value EC and the reference value Sref.

The scan voltage control unit 170 supplies a power source for amplifying an output voltage Vscan of the scan signal according to the control signal CS of the comparison unit 150 to a level shifter 173 of the scan driving unit 17. For example, the scan voltage control unit 170 can reduce the voltage difference |VD2|+|Vscan| between a voltage VD2 of the data electrode line and the output voltage Vscan of the scan signal by controlling the magnitude of the output voltage of the scan signal and inversely proportional to the control signal CS of the comparison unit 150. In this case, the control signal CS increases as the discharge current value EC that flows in the anode 22 is greater than the reference value Sref, and the output voltage Vscan decreases since the output voltage Vscan of the scan signal is inversely proportional to the control signal CS. Accordingly, the background-brightness is reduced in accordance with the voltage difference |VD2|+|Vscan| between the voltage VD2 of the data electrode lines and the output voltage Vscan of the scan signal.

As depicted in FIG. 6, the EED can further include a switch unit 160, which is turned on when a logic value of predetermined image data is zero, between the comparison unit 150 and the scan voltage control unit 170. The switch unit 160 can be turned on when image data greater than at least one frame is zero. The switch unit 160 can query data of a frame memory 165. For example, the switch unit 160 can access a predetermined address and can read data corresponding thereto. The reason for the switch unit 160 determining on/off according to the data is that the background-brightness does not need to be controlled when the predetermined data value is not zero.

Figure 7:
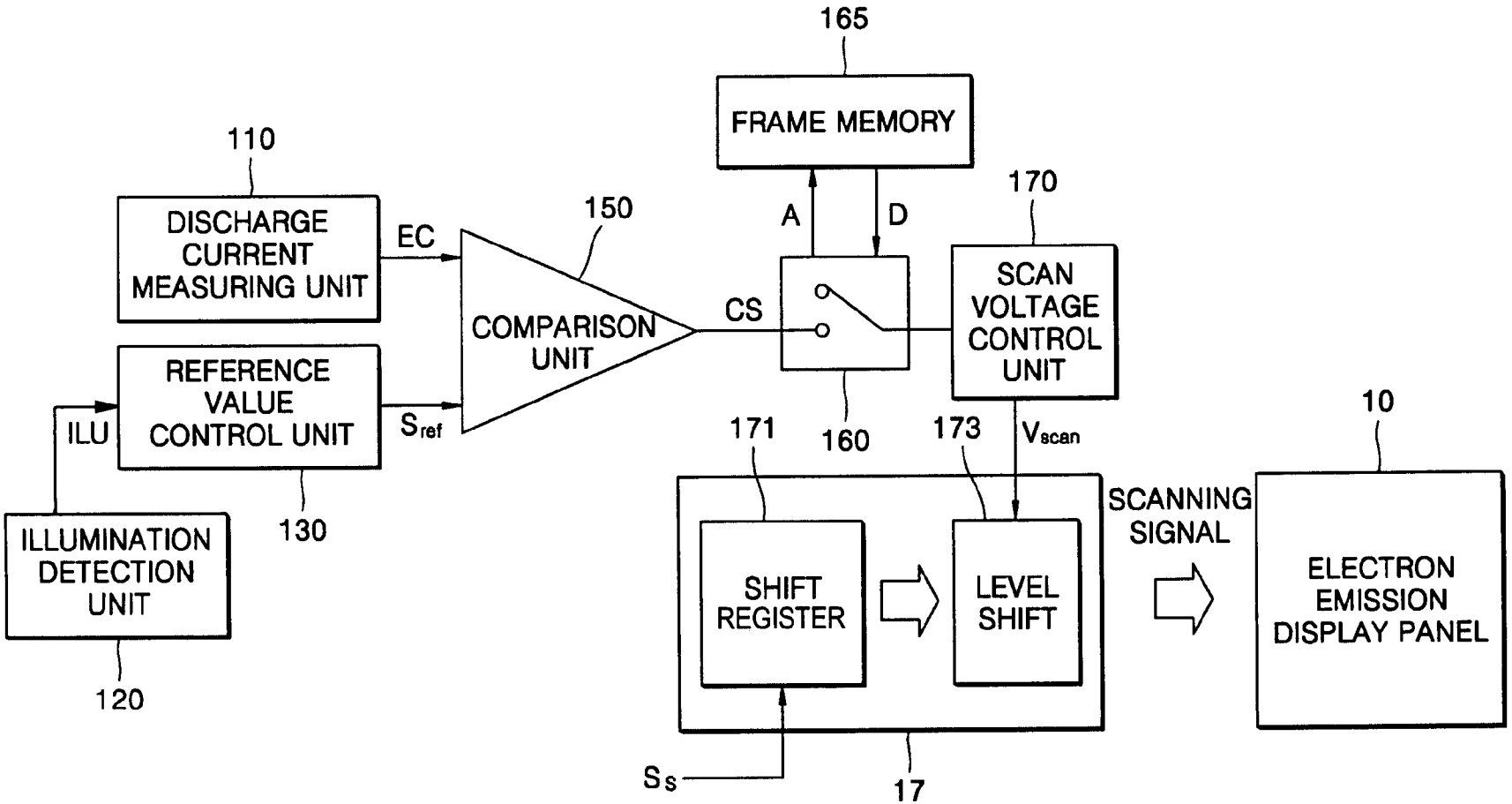
FIG. 7 is a block diagram of an EED that controls the voltage of a scan signal according to an embodiment of the present invention.

On the other hand, as depicted in FIG. 7, the electron emission device according to the present invention can further include an illumination detection unit 120 that outputs illumination signals ILU by measuring an illumination of external light and a reference value control unit 130 that generates the reference value Sref by amplifying the illumination signals ILU.

The illumination detection unit 120 outputs the illumination signals ILU according to the degree of illumination peripheral to the electron emission device, that is, the brightness of external light. The illumination detection unit 120 can include a photosensor. The reference value control unit 130 supplies a reference value Sref by amplifying and outputting an illumination signal ILU received from the illumination detection unit 120 to an input terminal of the comparison unit 150. As depicted in FIG. 7, the electron emission device having the illumination detection unit 120 can set a low reference value Sref supplied to the comparison unit 150 since the background-brightness outputted from the panel must be set low when peripheral illumination is low. On the contrary, the reference value Sref supplied to the comparison unit 150 can be set high since the background-brightness outputted from the panel need not be set low when the peripheral illumination is high.

In the scan driving unit 17, the scanning signals are outputted by one horizontal line per shift by sequentially shifting the scanning signals according to the scan clock (conventionally, the frequency is identical to a horizontal synchronizing signal) in a shift register 171. The shift register 171 of the scan driving unit 17 shifts the scanning signals for every clock.

A level shifter 173 of the scan driving unit 17 sequentially supplies scanning signals (the gate electrodes in FIG. 2 or the cathodes in FIG. 3) to the scan electrodes after increasing the scanning signals received from the scan voltage control unit 170 to a predetermined high voltage Vscan.

The electron emission device according to the present invention has following advantages.

First, light generated by the electron emission display panel, when data is not supplied to the data electrode lines, that is, when zero data is continuously supplied to the data electrode lines, can be prevented.

Second, background-brightness resulting from only a few electrons colliding with the anode when data is not supplied to the electron emission display panel can be obviated by measuring a discharge current value and by reducing a voltage difference between a voltage of the scan electrode and a voltage of the data electrode proportional to the discharge current value.

Third, contrast and visibility of the electron emission display panel are degraded, even if a display data signal is not zero when the background-brightness is high since the brightness affects a naked eye. However, the EED according to the present invention improves contrast, visibility, and the quality of a feeling image of the electron emission display panel not only when the display data signal is zero but also when the display data signal is not zero.

While the present invention has been particularly shown and described with reference to embodiments thereof, it will be understood by those of ordinary skill in the art that various modifications in form and detail can be made therein without departing from the spirit and scope of the present invention as defined by the following claims.

What is claimed is:

1. An Electron Emission Device (EED), comprising:

an electron emission display panel including scan electrodes, data electrodes, and anodes, electrons colliding with the anode in accordance with a voltage difference between the scan electrodes and the data electrodes;

a discharge current measuring unit adapted to measure a discharge current value of the electron emission display panel;

a comparison unit adapted to output control signals proportional to a current difference between the measured discharge current value and an inputted reference value;

a scan voltage control unit adapted to amplify an output voltage of sequentially outputted scanning signals to scan electrode lines of the electron emission display panel according to scan driving signals having a predetermined frequency, the scan voltage control unit operating in accordance with the control signals of the comparison unit;

a scan driving unit adapted to sequentially supply scan signals having an amplified output voltage to the scan electrode lines, the scan signals having a changed voltage difference between the anode and the scan electrode lines due to the amplified output voltage; and a switch unit arranged between the comparison unit and the scan voltage control unit, the switch unit adapted to be turned on in response to a logic value of a predetermined image data being zero.

2. The EED of claim 1, wherein the discharge current measuring unit is adapted to detect a current flowing through the anode by connecting to the anode of the electron emission display panel.

3. The EED of claim 1, wherein the discharge current measuring unit is adapted to detect a current flowing through the scan electrode by connecting to the scan electrode of the electron emission display panel.

4. The EED of claim 1, wherein the switch unit is adapted to be turned on in response to the image data of at least more than one frame being zero.

5. The EED of claim 1, wherein the switch unit is adapted to be turned on in response to the image data of at least more than 60 frames being zero.

6. The EED of claim 1, wherein the scan voltage control unit is adapted to reduce a voltage difference between a voltage supplied to the data electrode lines and the output voltage of the scanning signals by controlling the magnitude of the output voltage of the scanning signals to be inversely proportional to the control signals of the comparison unit.

7. The EED of claim 1, further comprising:

an illumination detection unit adapted to output illumination signals by measuring external illumination; and a reference value control unit adapted to generate the reference value by amplifying the illumination signals, the reference value received by the comparison unit being received from the reference value control unit.

* * * * *